US008006945B2

(12) United States Patent
Chen

(10) Patent No.: US 8,006,945 B2
(45) Date of Patent: Aug. 30, 2011

(54) BICYCLE SUPPORT DEVICE

(75) Inventor: Mu-Tsun Chen, Taichung Hsien (TW)

(73) Assignee: Giant Manufacturing Co., Ltd., Taichung Hsien (TW)

( * ) Notice: Subject to any disclaimer, the term of this patent is extended or adjusted under 35 U.S.C. 154(b) by 30 days.

(21) Appl. No.: 12/748,454

(22) Filed: Mar. 29, 2010

(65) Prior Publication Data

US 2011/0073721 A1 Mar. 31, 2011

(30) Foreign Application Priority Data

Sep. 29, 2009 (TW) ..... 98132973 A

(51) Int. Cl.
*F16L 3/00* (2006.01)

(52) U.S. Cl. ..... 248/121; 482/61

(58) Field of Classification Search ..... 248/682, 248/688, 121, 146, 158; 482/57, 61
See application file for complete search history.

(56) References Cited

U.S. PATENT DOCUMENTS

| | | | | |
|---|---|---|---|---|
| 4,955,600 | A * | 9/1990 | Hoffenberg et al. | 482/61 |
| 5,382,208 | A * | 1/1995 | Hu | 482/63 |
| 7,442,152 | B2 * | 10/2008 | Peterson et al. | 482/57 |
| 7,758,474 | B1 * | 7/2010 | Pedrini | 482/61 |
| 2004/0053751 | A1 * | 3/2004 | Pizolato | 482/61 |
| 2010/0062909 | A1 * | 3/2010 | Hamilton | 482/61 |

* cited by examiner

*Primary Examiner* — Ramon Ramirez
(74) *Attorney, Agent, or Firm* — CKC & Partners Co., Ltd.

(57) ABSTRACT

A bicycle support device includes at least one supporting base and at least one hanging part. The hanging part is telescopically connected to the supporting base and has at least one groove located thereon. At least a part of the groove of the hanging part protrudes from the supporting base for hanging a bicycle wheel.

10 Claims, 6 Drawing Sheets

BICYCLE SUPPORT DEVICE

RELATED APPLICATIONS

The application claims priority to Taiwan Application Serial Number 98132973, filed Sep. 29, 2009, which is herein incorporated by reference.

BACKGROUND

1. Technical Field

The present disclosure relates to exercise devices.

2. Description of Related Art

Living in the highly competitive society of the 21st century, people are often busy at work and overlook the importance of health. In order to do some exercise in their daily life, some people use indoor bicycle trainers. The bicycle trainer includes a support device. The support device can suspend the bicycle from the ground, and then it is possible to ride a bike without moving forward. Therefore, people can do exercise at home.

SUMMARY

According to one embodiment of the present disclosure, a bicycle support device includes a frame, at least one rod, at least one supporting base, at least one hanging part, and at least one elastic member. The rod is slidably connected to the frame. The supporting base is connected to one end of the rod. The hanging part is telescopically connected to the supporting base and has at least one groove located thereon. The elastic member connects the supporting base and the hanging part for pushing the hanging part away from the supporting base such that at least a part of the groove of the hanging part will protrude from the supporting base for hanging a bicycle wheel.

DETAILED DESCRIPTION

In the following detailed description for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
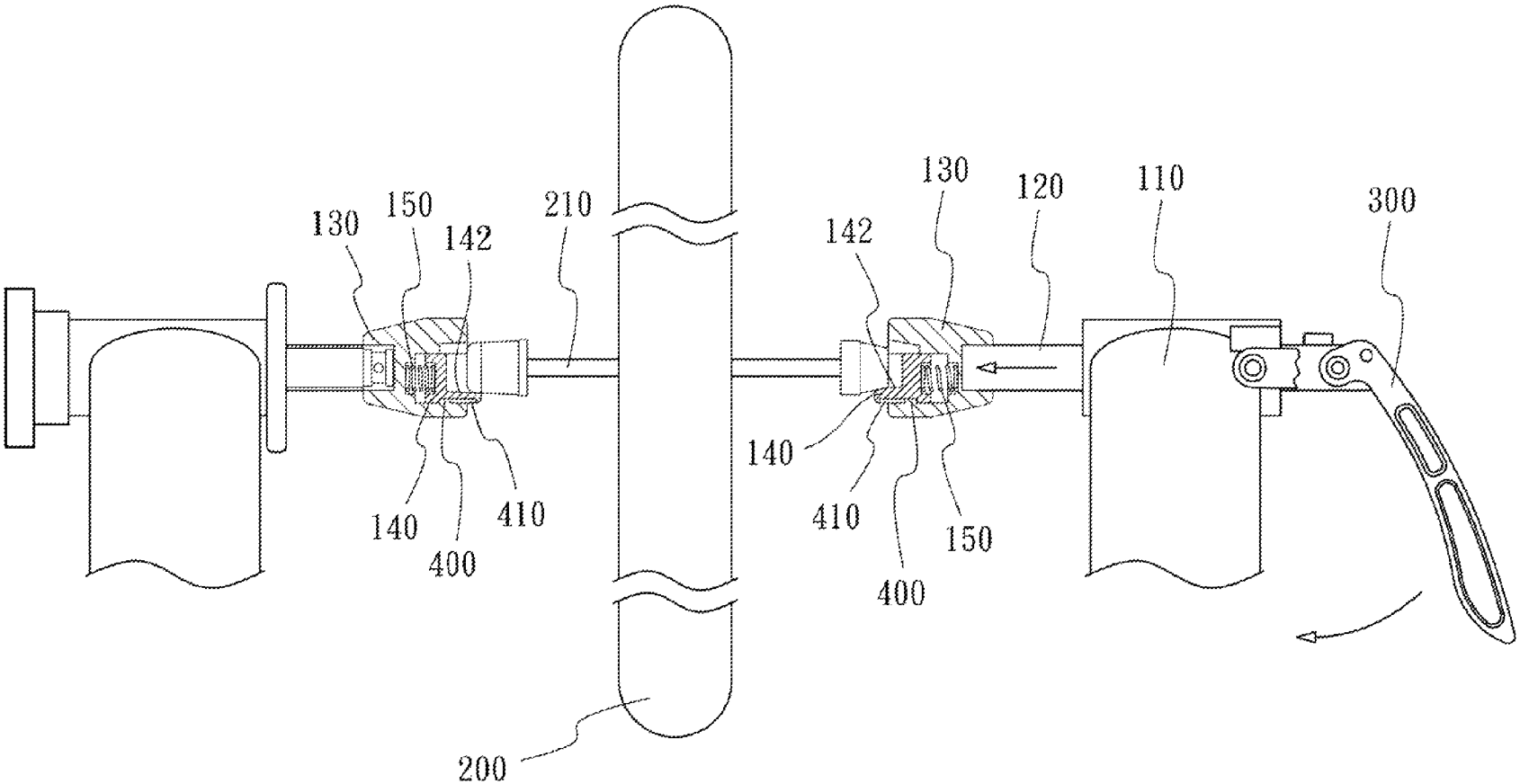
FIG. 1 is a plan view of a bicycle support device according to one embodiment of the present disclosure.

FIG. 1 is a plan view of a bicycle support device according to one embodiment of the present disclosure. The bicycle support device includes a frame 110, a rod 120, at least one supporting base 130, at least one hanging part 140, and at least one elastic member 150. The rod 120 is slidably connected to the frame 110. The supporting base 130 is connected to one end of the rod 120. The hanging part 140 is telescopically connected to the supporting base 130 and includes at least one groove 142 located thereon. The elastic member 150 connects the supporting base 130 and the hanging part 140. The elastic member 150 can push the hanging part 140 away from the supporting base 130 such that at least a part of the groove 142 of the hanging part 140 will protrude from the supporting base 130 for hanging a bicycle wheel 200.

Figure 2:
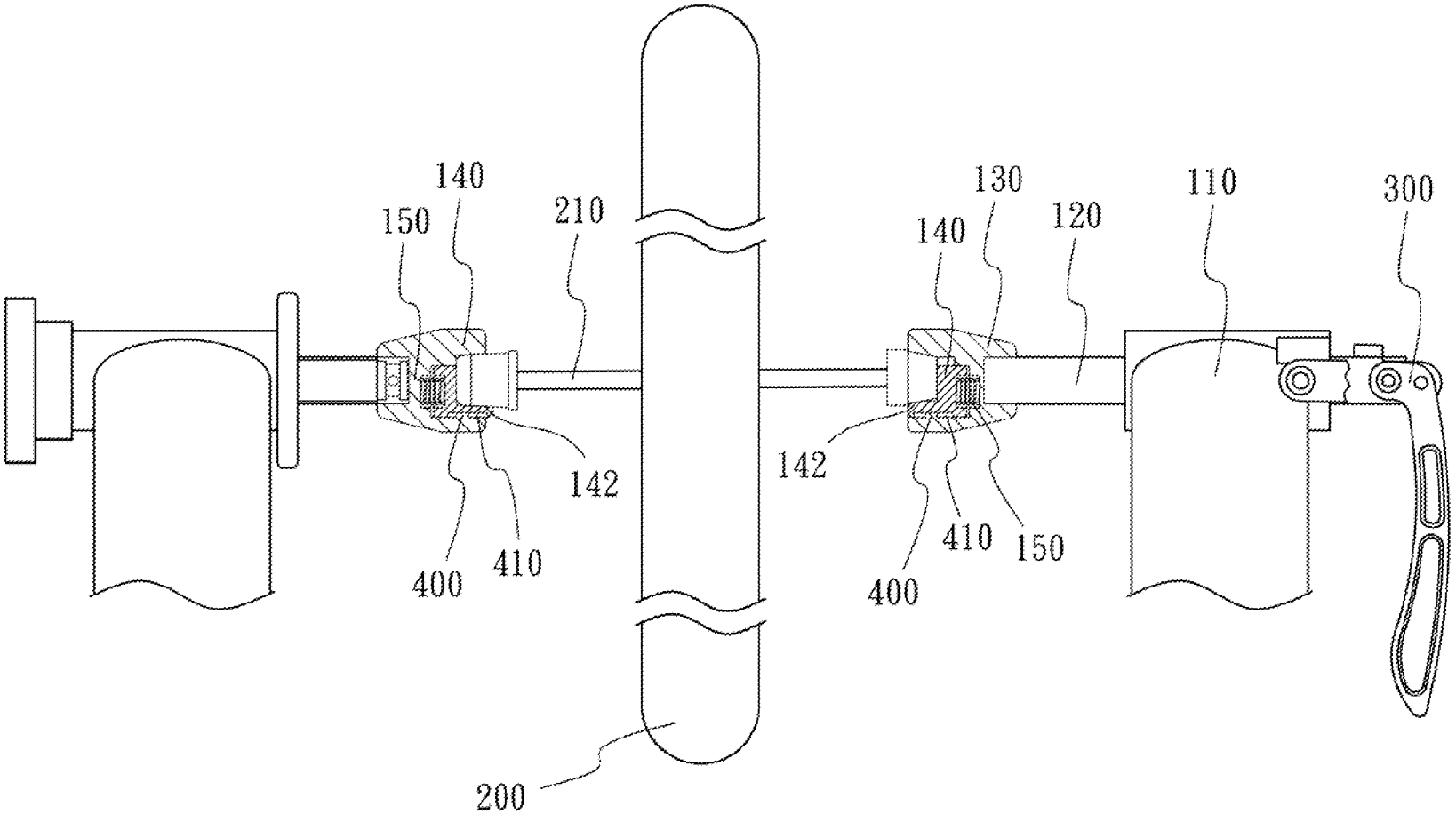
FIG. 2 is a plan view of the bicycle support device of FIG. 1 depicting the quick-release mechanism is secured.

When using, the user can lift the bicycle wheel 200 and dispose the axle 210 of the bicycle wheel 200 into the groove 142 of the hanging part 140. Thus, the bicycle wheel 200 is suspended from the ground (shown in FIG. 1). Then, the user can secure the quick-release mechanism 300 to advance the rod 120 to push the hanging part 140 against the bicycle wheel 200. As shown in FIG. 2, the hanging part 140 can hold the axle 210 of the bicycle wheel 200 firmly at this time.

Figure 3B:
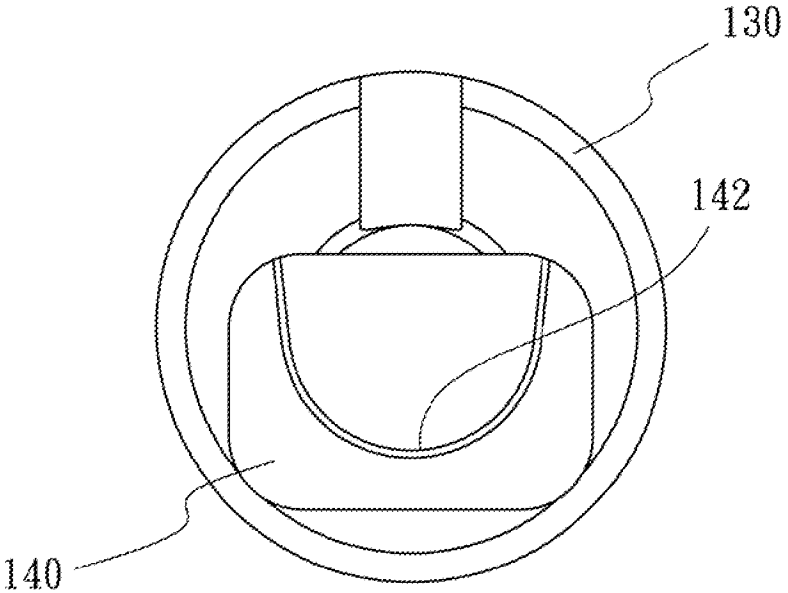
FIG. 3B is a front view of the supporting base and the hanging part of FIG. 1.
Figure 3A:
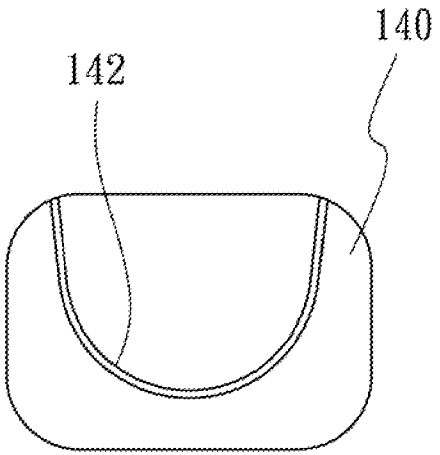
FIG. 3A is a front view of the hanging part of FIG. 1.

FIG. 3A is a front view of the hanging part 140 of FIG. 1. FIG. 3B is a front view of the supporting base 130 and the hanging part 140 of FIG. 1. The supporting base 130 is hollow and has an open end. The hanging part 140 is surrounded by the supporting base 130. The groove 142 is arc-shaped to fit the axle 210 of the bicycle wheel 200.

The term "elastic member" means an element can return to its original shape once the forces are no longer applied, such as a spring or a rubber. In use, the elastic member 150 can be compressed by the axle 210 of the bicycle wheel 200 when the quick-release mechanism 300 is secured. Once the quick-release mechanism 300 is released, the elastic member 150 can return to its original shape to push the hanging part 140 away from the supporting base 130.

Figure 4B:
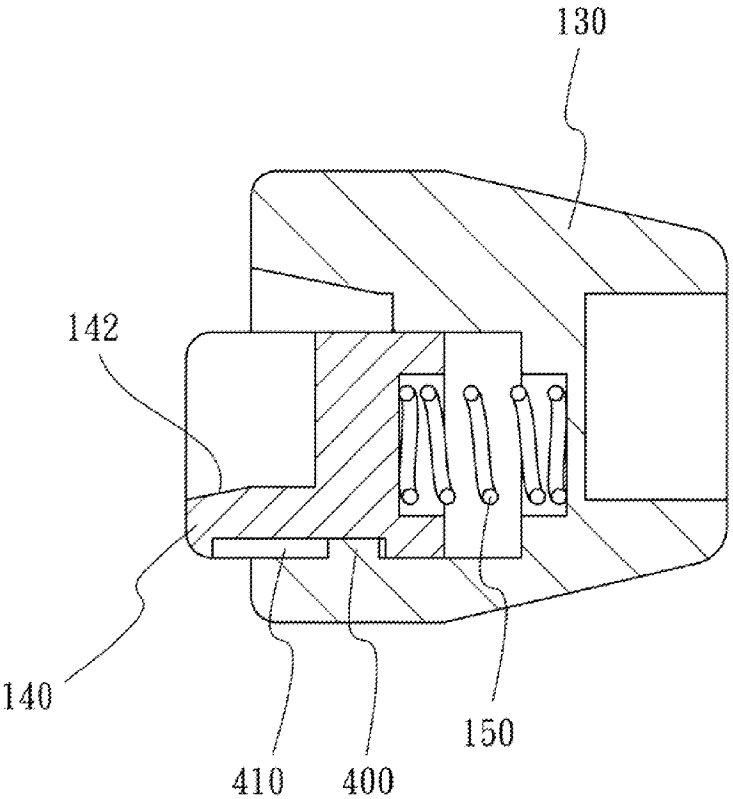
FIG. 4B is a cross-sectional view of the supporting base, the hanging part and the elastic member of FIG. 1.
Figure 4A:
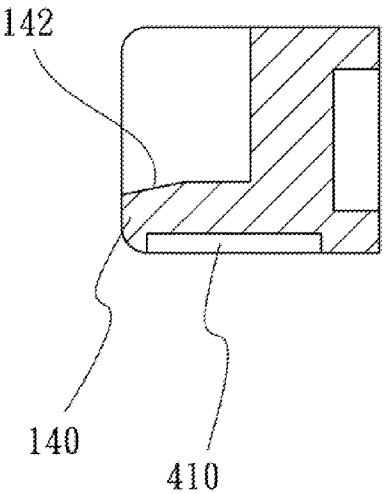
FIG. 4A is a cross-sectional view of the hanging part of FIG. 1.

FIG. 4A is a cross-sectional view of the hanging part 140 of FIG. 1. FIG. 4B is a cross-sectional view of the supporting base 130, the hanging part 140 and the elastic member 150 of FIG. 1. The bicycle support device further includes a protruding part 400 and a slot 410. The protruding part 400 protrudes from the supporting base 130. The slot 410 is located on the hanging part 140 and slidably connected to the protruding part 400. Therefore, the hanging part 140 can be restrained from separating from the supporting base 130 by the protruding part 400 and the slot 410.

Figure 5:
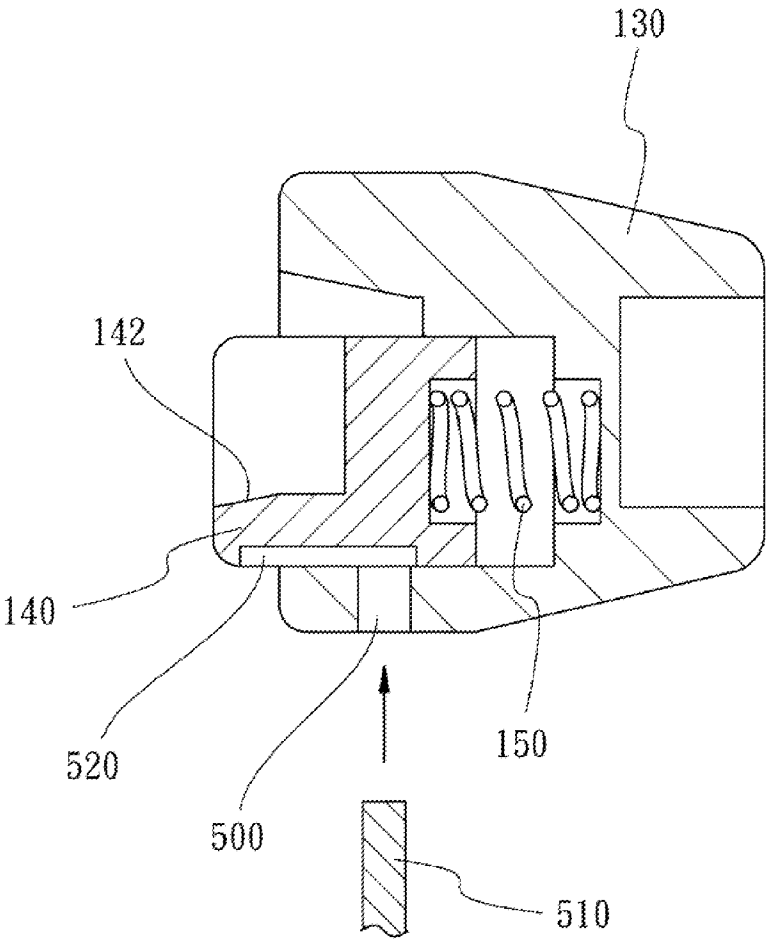
FIG. 5 is a cross-sectional view of the supporting base, the hanging part and the elastic member according to another embodiment of the present disclosure.

FIG. 5 is a cross-sectional view of the supporting base 130, the hanging part 140 and the elastic member 150 according to another embodiment of the present disclosure. In FIG. 5, the bicycle support device further includes a hole 500, a pin 510 and a slot 520. The hole 500 is located in the supporting base 130. The pin 510 is inserted into the hole 500. The slot 520 is located on the hanging part 140 and is slidably connected to the pin 510. Similarly, the hanging part 140 can be restrained from separating from the supporting base 130 by the hole 500, the pin 510 and the slot 520.

Figure 6:
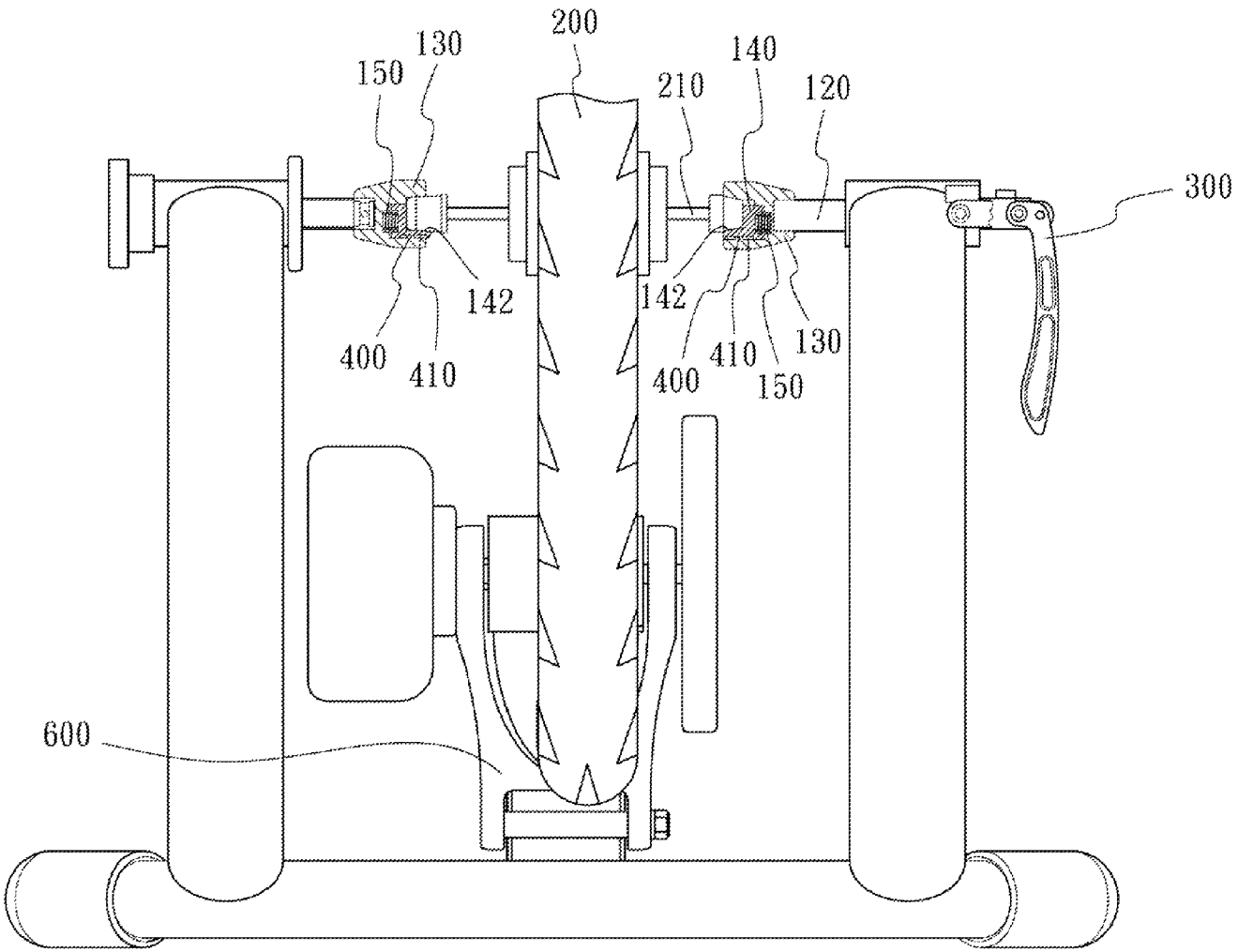
FIG. 6 is a front view of a bicycle trainer with the bicycle support device of FIG. 1.

FIG. 6 is a front view of a bicycle trainer with the bicycle support device of FIG. 1. In practice, the bicycle support device may be used in a bicycle trainer to suspend the bicycle wheel from the ground. It is appreciated that the bicycle support device may also be configured to other apparatuses to hold the bicycle.

What is claimed is:

1. A bicycle support device, comprising:

a frame;

at least one rod slidably connected to the frame;

at least one supporting base connected to one end of the rod;

at least one hanging part telescopically connected to the supporting base and having at least one groove located thereon; and at least one elastic member connecting the supporting base and the hanging part for pushing the hanging part away from the supporting base such that at least a part of the groove of the hanging part will protrude from the supporting base for hanging a bicycle wheel.

2. The bicycle support device of claim 1, further comprising:

a protruding part protruding from the supporting base; and a slot located on the hanging part and slidably connected to the protruding part.

3. The bicycle support device of claim 1, further comprising:

a hole located in the supporting base;

a pin inserted into the hole; and a slot located on the hanging part and slidably connected to the pin.

4. The bicycle support device of claim 3, wherein the pin is a bolt.

5. The bicycle support device of claim 1, further comprising:

a quick-release mechanism for advancing the rod to push the hanging part against the bicycle wheel.

6. A bicycle support device, comprising:

a frame;

at least one rod slidably connected to the frame;

at least one supporting base connected to one end of the rod;

at least one hanging part telescopically connected to the supporting base and having at least one groove located thereon; and means for advancing the hanging part to expose at least a part of the groove of the hanging part for hanging a bicycle wheel.

7. The bicycle support device of claim 6, further comprising:

a protruding part protruding from the supporting base; and a slot located on the hanging part and slidably connected to the protruding part.

8. The bicycle support device of claim 6, further comprising:

a hole located in the supporting base;

a pin inserted into the hole; and a slot located on the hanging part and slidably connected to the pin.

9. The bicycle support device of claim 8, wherein the pin is a bolt.

10. The bicycle support device of claim 6, further comprising:

a quick-release mechanism for advancing the rod to push the hanging part against the bicycle wheel.

* * * * *